US008360285B2

(12) United States Patent
Grbesic

(10) Patent No.: US 8,360,285 B2
(45) Date of Patent: Jan. 29, 2013

(54) METERING DEVICE

(76) Inventor: Thomas Grbesic, Boeblingen (DE)

( * ) Notice: Subject to any disclaimer, the term of this patent is extended or adjusted under 35 U.S.C. 154(b) by 265 days.

(21) Appl. No.: 12/756,189

(22) Filed: Apr. 8, 2010

(65) Prior Publication Data

US 2010/0230442 A1 Sep. 16, 2010

Related U.S. Application Data

(63) Continuation of application No. PCT/EP2008/008496, filed on Oct. 8, 2008.

(30) Foreign Application Priority Data

Oct. 8, 2007 (DE) ..... 10 2007 049 367

(51) Int. Cl.
*B65D 37/00* (2006.01)
*B67D 7/58* (2010.01)
*B67D 7/06* (2010.01)

(52) U.S. Cl. ..... 222/207; 222/214; 222/325; 222/181.3; 222/383.1

(58) Field of Classification Search ..... 222/207, 222/214, 325, 181.3, 181.2, 372, 383.1
See application file for complete search history.

(56) References Cited

U.S. PATENT DOCUMENTS

| | | | | |
|---|---|---|---|---|
| 3,871,558 | A * | 3/1975 | Gournelle | 222/181.2 |
| 4,168,020 | A | 9/1979 | Benson | |
| 4,330,071 | A | 5/1982 | Ohlson | |
| 4,345,718 | A * | 8/1982 | Horvath | 239/333 |
| 4,393,982 | A * | 7/1983 | Kuckens | 222/209 |
| 4,561,571 | A * | 12/1985 | Chen | 222/207 |
| 4,717,047 | A * | 1/1988 | van Overbruggen et al. | 222/207 |
| 4,776,495 | A * | 10/1988 | Vignot | 222/207 |
| 4,828,150 | A * | 5/1989 | Bottger et al. | 222/207 |
| 4,949,877 | A * | 8/1990 | Hanna et al. | 222/341 |
| 4,993,600 | A * | 2/1991 | Tucker et al. | 222/321.6 |
| 2004/0191128 | A1 | 9/2004 | Bogen et al. | |
| 2006/0049208 | A1 | 3/2006 | Daansen | |
| 2008/0029556 | A1 | 2/2008 | Chen | |

FOREIGN PATENT DOCUMENTS

| | | | |
|---|---|---|---|
| DE | 27 31 980 | | 4/1978 |
| DE | 27 50 936 | | 3/1979 |
| DE | 30 38 184 | A1 | 4/1984 |
| DE | 29906082 | | 9/1999 |
| FR | 2 597 551 | | 10/1987 |
| GB | 827778 | | 2/1960 |
| GB | 2 025 515 | | 1/1980 |
| WO | PCT/US95/13118 | | 5/1996 |
| WO | WO 2005/070272 | | 8/2005 |
| WO | PCT/EP2008/004164 | | 12/2008 |
| WO | PCT/EP2008/008496 | A3 | 4/2009 |

* cited by examiner

*Primary Examiner* — Kevin P Shaver
*Assistant Examiner* — Leslie Tanner
(74) *Attorney, Agent, or Firm* — Timothy M. Barlow

(57) ABSTRACT

A dosing apparatus for fluid, in particular pasty, substances such as toothpaste, liquid soap, mustard, etc., comprises a pump which has a filling nozzle which forms a suction opening of the pump in order to pump the pasty substance out of a container. An adapter has an inlet opening and an outlet opening for connecting a neck or an opening of the container to the filling nozzle of the pump. The outlet opening can be connected to the suction opening. The apparatus includes a two-part adapter housing where the upper part can be substituted for using different sized and shaped containers. The connection between the suction opening of the pump and the outlet opening of the adapter is designed to be releasable. The filling nozzle is formed coaxially to the adapter.

15 Claims, 6 Drawing Sheets

METERING DEVICE

CROSS REFERENCE TO RELATED APPLICATIONS

This is a Continuation application of International patent application PCT/EP2008/008496, filed Oct. 8, 2008, which claims the priority of German patent application DE 10 2007 049 367.5, filed Oct. 8, 2007.

BACKGROUND OF THE INVENTION

The invention relates to a dosing apparatus for fluid, in particular pasty, substances such as toothpaste, liquid soap, mustard, etc., comprising a pump which has a filling nozzle which forms a suction opening of the pump in order to pump the pasty substance out of a container, an adapter which has an inlet opening and an outlet opening for connecting a neck or an opening of the container to the filling nozzle of the pump, wherein the outlet opening can be connected to the suction opening.

The invention also relates to a pump for dosing fluid, in particular pasty, substances such as toothpaste, liquid soap, mustard, etc., comprising a basic body, a filling nozzle which is formed on the basic body and which forms a suction opening for sucking in a pasty substance, an outlet nozzle which is formed on the basic body and which is connected to an outlet valve, for dispensing the pasty substance.

The invention also relates to an adapter for a dosing dispenser with an inlet opening and an outlet opening for connecting a pump to a container, comprising a fixing sleeve or fixing means which is or are arranged on the inlet opening, for holding a neck or a connecting portion of the container, a line portion which connects the pump to the container, wherein a valve which determines a flow direction in the line portion is arranged in the line portion, a sealing member which has a sealing membrane which forms a sealed connection between the line portion and the neck or the connecting portion, a housing to which the sealing membrane and the fixing sleeve or the fixing means are fastened.

Such metering devices serve to provide defined amounts of the pasty substance from a supply container and thus facilitate the handling.

WO 2005/070272 A1 discloses a dosing apparatus for dispensing toothpaste onto a toothbrush head. Here, a sleeve of the dosing apparatus is connected to a toothpaste container. The sleeve is also connected to a pump bellows which can produce both an overpressure and a negative pressure. By means of two non-return valves, the toothpaste can be sucked out of the container, conveyed through the bellows and be dispensed dosed from a spout valve.

DE 299 06 082 U1 discloses a tube holder which comprises a suction pump and a tube holder housing into which a tube to be emptied can be screwed. Here, the suction pump is fixedly connected to the tube holder housing.

A disadvantage with the known tube holders and dosing apparatus is that only one connecting sleeve is provided for connecting a supply container and thus only a defined supply container can be used. A further disadvantage is that the whole pumping device has a closed design and it is thus made more difficult to clean the pumping device to remove, for example, dried-on or spoiled substances.

BRIEF SUMMARY OF THE INVENTION

It is therefore the object of the present invention to provide a dosing apparatus which can be used for different supply containers and is easy to clean.

This object is achieved in the initially mentioned dosing apparatus in that the connection between the suction opening of the pump and the outlet opening of the adapter is designed to be releasable, and the filling nozzle is formed coaxially to the adapter.

Furthermore, the above object is achieved by an initially mentioned pump in which there is also formed on the basic body a pump flange to which an elastic pump member is connected, for producing an overpressure or negative pressure in the basic body of the pump.

Furthermore, the above object is achieved by an initially mentioned adapter in which the fixing sleeve or the fixing means is or are designed to be exchangeable separately from the sealing membrane.

The advantage of the dosing apparatus according to the invention is that the pump can be released from the adapter and thus the basic body can be cleaned through the suction opening.

The advantage of the pump according to the invention is that the basic body can be easily cleaned through the three openings formed therein.

The advantage of the adapter according to the invention is that differently formed fixing sleeves can be used in order thus to be able to connect different containers.

The object of the invention is thus completely achieved.

In a preferred embodiment, the pump member is formed as an elastic pump membrane. As a result, an overpressure or negative pressure can be produced in the basic body and thus a pump can be produced with little structural outlay.

In a preferred embodiment, a plunger is arranged on the pump membrane in such a way that the pump membrane can be deflected with respect to the basic body by means of pressure on the plunger.

Consequently, by exerting a pressure on the plunger, an overpressure can be produced in the basic body and a pumping action can thus be easily achieved.

In a preferred embodiment, the outlet valve is designed as a nonreturn valve. This makes it possible to prevent the negative pressure produced in the basic body from being equalized by sucking in ambient air.

In a preferred embodiment, the outlet valve is designed as a spout valve. It is advantageous here for the spout valve to form both a dispenser opening and to simultaneously serve as a nonreturn valve.

It is particularly preferred for the housing of the adapter to be formed from an upper part and a lower part.

This has the advantage that the housing of the adapter can be easily disassembled and a simple and complete cleaning is possible.

In a further embodiment, the upper part can be connected to the lower part by snap-fastening. As a result, the upper part can be easily and quickly connected to or released from the lower part.

In a preferred embodiment, the upper part can be screwed to the lower part by means of a thread.

As a result, the upper part can be fixedly connected to and easily released from the lower part.

In a preferred embodiment of the adapter, the fixing sleeve or the fixing means have, on an outer edge, a rib portion which engages in a groove portion on an inner edge of the opening of the upper part.

As a result, different fixing sleeves can be releasably and stably connected to the upper part.

In a preferred embodiment, the sealing membrane and the line portion are formed in one piece. As a result, the sealing membrane can be produced in a single manufacturing step together with the line portion.

In a preferred embodiment, the sealing membrane is elastically preloaded by means of a spring element such that the sealing membrane bears on the fixing sleeve or the fixing means.

As a result, the sealing membrane can be pressed against the neck of the container and thus a sealed connection can be ensured.

It is preferred if the fixing means comprise fixing grippers which can be brought into engagement with a connecting portion of the container.

As a result, differently designed containers with different connecting portions can be connected to the adapter.

Alternatively, it is preferred if the fixing means comprise a screw portion which can be connected to the fixing portion of the container.

As a result, differently formed containers can be connected in a simple manner to the adapter.

In a preferred embodiment, the valve is designed as a spout valve.

As a result, a nonreturn valve can be produced simply and cost-effectively in the line portion.

In a preferred embodiment, the line portion has, at an end opposite to the sealing member, a cylindrical portion which is designed to surround a filling nozzle of the pump if the sealing membrane is pressed in by introducing a neck of a container into the adapter.

As a result, the line portion can be connected in a sealed manner to the filling nozzle of the pump.

In a preferred embodiment, the line portion has, at an end opposite to the sealing membrane, a cylindrical portion which is designed to surround a filling nozzle of the pump if the upper part and the lower part are connected to one another.

As a result, the line portion can be connected in a sealed manner to the filling nozzle of the pump by a simple manual maneuver.

In an alternative embodiment, the line portion has, at an end opposite to the sealing membrane, a cylindrical portion which is designed to be introduced into a filling nozzle of the pump if the sealing membrane is pressed in by introducing a neck of a container into the adapter.

As a result, the filling nozzle of the pump can be clamped in between the flange of the adapter and the cylindrical portion, thereby forming a sealed connection.

In an alternative embodiment, the line portion has, at an end opposite to the sealing membrane, a cylindrical portion which is designed to be introduced into a filling nozzle of the pump if the upper part and the lower part are connected to one another.

It is thus possible to achieve a sealed and stable connection between the adapter and the pump, which can be mounted by simple manual maneuvers.

In a further embodiment, the cylindrical portion is arranged between a conical flange of the lower part and the filling nozzle of the pump when it surrounds the filling nozzle.

It is advantageous here for the cylindrical portion to be supported laterally in this position by the conical flange and thus form a rigid connection with the filling nozzle.

In a preferred embodiment, the cylindrical portion has, at an end facing the pump, an annular shoulder on its inner circumferential surface.

As a result, the line portion can be mechanically fixedly connected and securely sealed to the filling nozzle of the pump.

In a preferred embodiment, the spring element is designed as a coil spring.

As a result, the spring element can be arranged coaxially around the line portion and exert a uniform pressure on the sealing membrane.

In a preferred embodiment, the sealing member comprises a double-cylindrical component of an elastic material, wherein the two coaxial cylinders are connected to the sealing membrane.

As a result, the sealing membrane can be manufactured cost-effectively and mounted together with the line portion.

In a preferred embodiment, the valve is arranged in the inner cylinder of the sealing member.

It is thus possible to prevent the overpressure produced by the pump from escaping through the line portion.

It will be understood that the features mentioned above and the ones still to be mentioned below can be used not only in the respectively indicated combination but also in other combinations or in isolation without departing from the scope of the present invention.

BRIEF DESCRIPTION OF THE SEVERAL VIEWS OF THE DRAWINGS

Exemplary embodiments of the invention are illustrated in the drawing and are explained in more detail below in the following description. In the drawing.

DETAILED DESCRIPTION OF THE INVENTION

Figure 1:
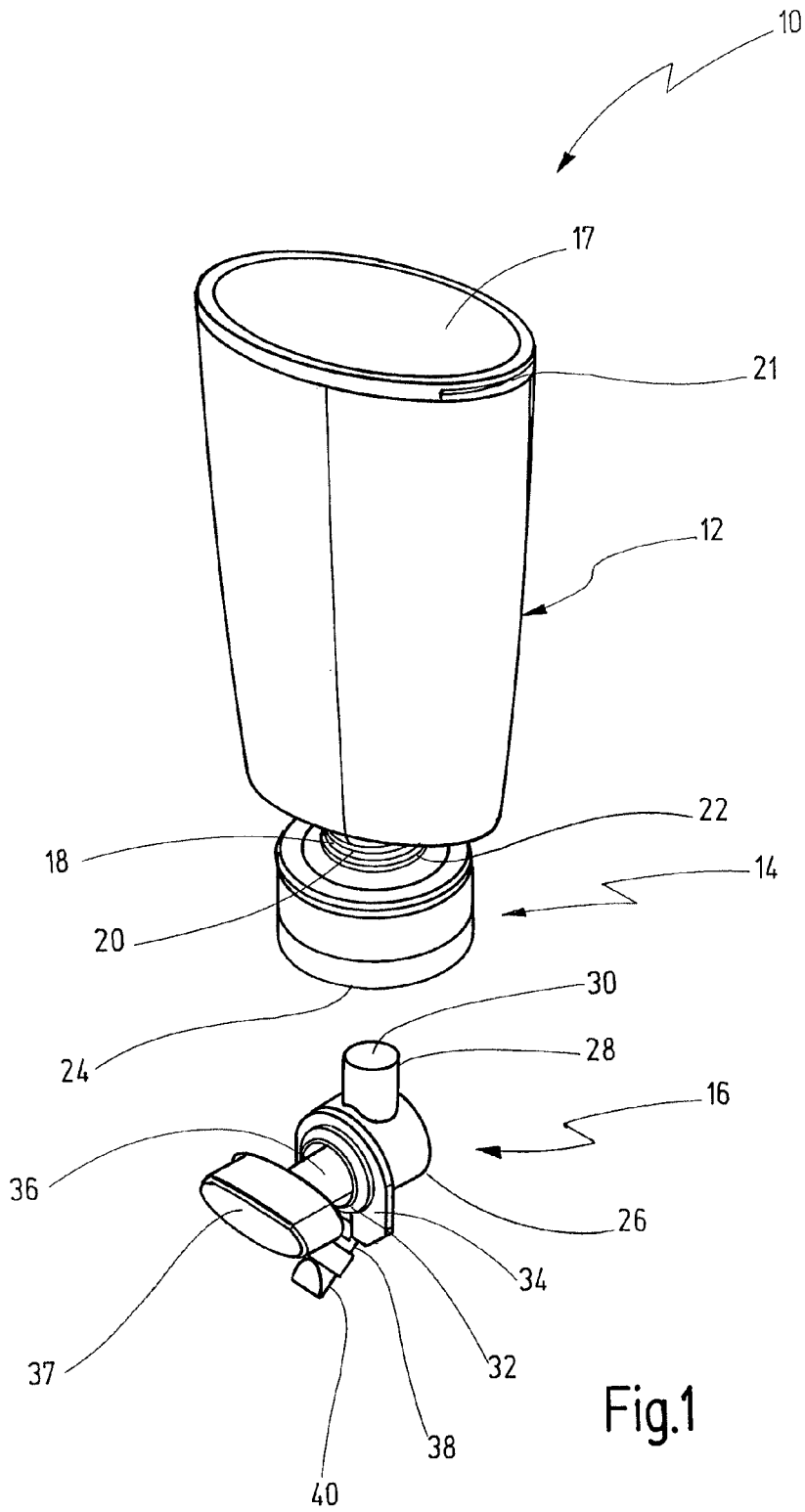
FIG. 1 shows a perspective exploded illustration of the dosing apparatus according to the invention with a container, an adapter and a pump.

In FIG. 1, the dosing apparatus according to the invention is generally designated by 10.

The dosing apparatus 10 has three subassemblies in one embodiment. These subassemblies are a container 12, an adapter 14 and a pump 16. At one end, the container 12 has a cover 17 and, at an end opposite to the cover 17, a neck 18 which encloses an opening 20. The cover 17 is arranged on a filling opening 21 of the container 12. The adapter 14 has an inlet opening 22 and an outlet opening 24. The neck 18 is introduced into the inlet opening 22, thereby connecting the container 12 to the adapter 14. The pump 16 has a basic body 26 on which there is arranged a filling nozzle 28 which surrounds a suction opening 30 of the pump 16. On the basic body 26 is formed a pump flange 32 on which there is arranged an elastic pump membrane 34 which tightly closes the pump flange 32. A pump plunger 36 on which a cap 37 is arranged is fastened to the pump membrane 34. Also arranged on the basic body 26 is an outlet nozzle 38 which is connected at a free end to a spout valve 40.

The container 12 serves as a supply vessel for a pasty substance which is to be dosed by the dosing apparatus. The container 12 has a neck 18 which is introduced into the inlet opening 22 of the adapter 14 and fastened there. The neck 18 surrounds the opening 20 which serves for emptying the container 12. Since the neck 18 of the container 12 is connected to the inlet opening 22 of the adapter 14, the pasty substance is provided to the adapter 14. The cover 17 closes the filling opening 21 through which the container 12 can be filled.

The filling nozzle 28 can be connected to the outlet opening 24 of the adapter 14. It is thus made possible for the pump 16 to be able to suck in the pasty substance through the suction opening 30, which substance is supplied to the adapter 14 through the opening 20 and can be provided dosed to a user through the outlet nozzle 38 and the spout valve 40. A pumping action is produced by exerting a force on the cap 37, which transmits this force to the pump plunger 36, the operation being explained in more detail below.

Figure 2:
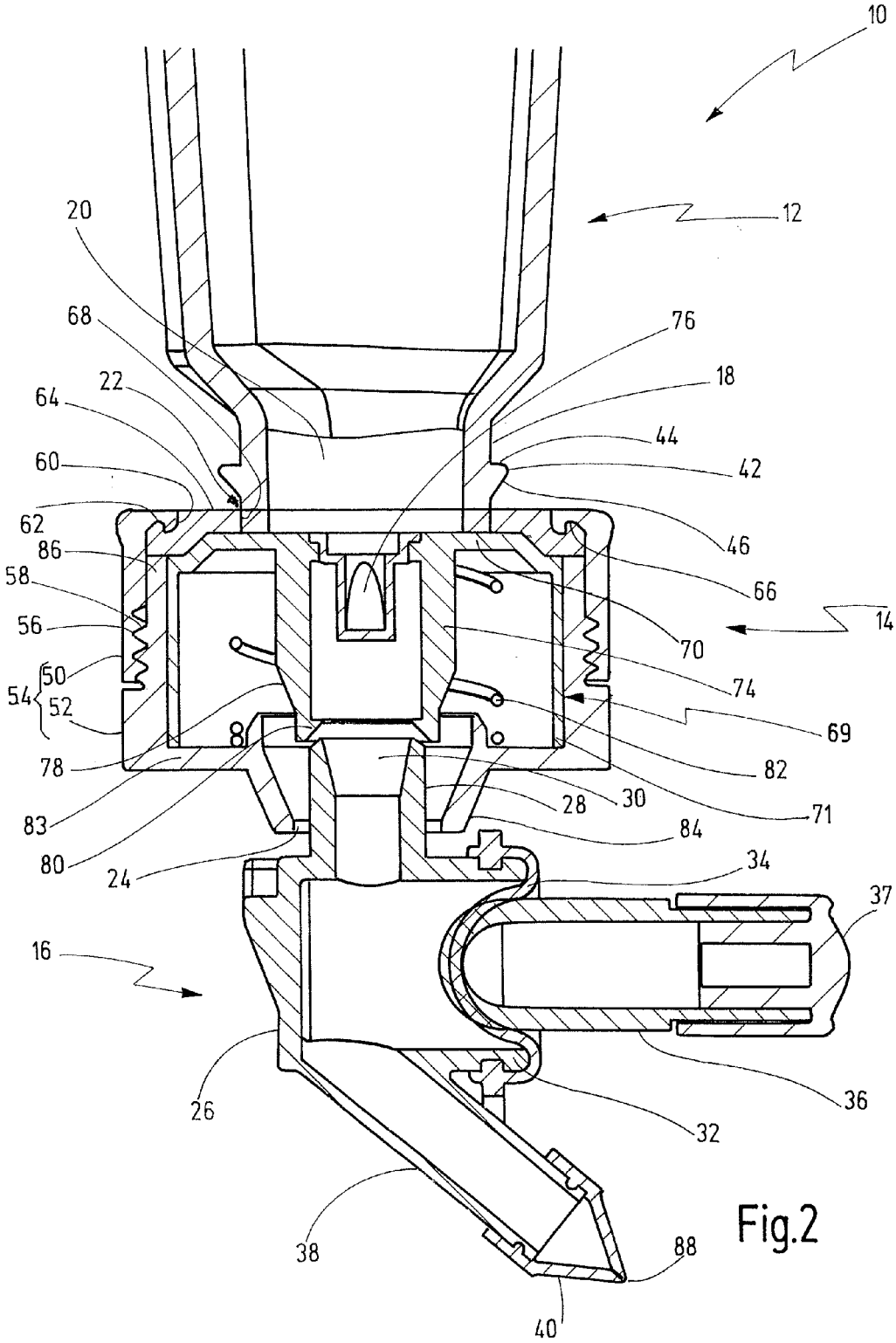
FIG. 2 shows a sectional view of an embodiment of the dosing apparatus.

FIG. 2 shows a sectional view of the subassemblies of the dosing apparatus 10. Here, the container 12, the adapter 14 and the pump 16 are represented coaxially to a longitudinal axis which is not depicted in greater detail, the dosing apparatus 10 in the position represented in FIG. 2 not being ready for operation.

The neck 18 of the container 12 has a collar 42 which is formed from a projecting edge on an outer circumferential surface of the neck 18. The collar 42 has a perpendicular portion 44 which extends perpendicular to a main axis of the container, and an oblique portion 46 which extends obliquely to the main axis of the container 12.

The adapter 14 has a cylindrical upper part 50 and a cylindrical lower part 52 which together form a housing 54 of the adapter 14. The upper part 50 and the lower part 52 each have a thread 56, 58 by means of which they can be connected to one another. The thread 56 is arranged on an inner circumferential surface of the upper part 50 and the thread 58 is arranged on an outer circumferential surface of the lower part 52. The upper part 50 has, at an end axially opposite to the thread 56, an opening 60 on whose edge is formed a circumferential groove 62. Arranged on the opening 60 of the upper part 50 is a flat, round fixing sleeve 64 which has an annular rib 66 at its radially outer edge. The rib 66 engages in a sealing manner in the groove 62.

The fixing sleeve 64 has, coaxially to the rib 66, the inlet opening 22 which is bounded by an inner edge 68 of the fixing sleeve 64 and the diameter of which corresponds to an outside diameter of the neck 18, in particular being smaller than or equal to the outside diameter. In the housing 54, the adapter 14 has a cylindrical sealing member 69 which is formed from an elastic material. The sealing member 69 has two coaxial cylindrical elements which are connected to one another at an axial end by a sealing membrane 70. The cylindrical elements comprise an outer cylindrical element 71 which bears on an inner circumferential surface of the lower part 52, and an inner line portion 74. Arranged in the line portion 74 is a nonreturn valve 76. The line portion 74 has, at an axial end opposite to the sealing membrane 70, a conical portion 78 on an outer circumferential surface. The line portion 74 has, at the axial end opposite to the sealing membrane 70, an annular shoulder 80 on an inner circumferential surface. In the housing 54, a coil spring 82 is arranged coaxially between the line portion 74 and the cylindrical element 71. The coil spring 82 is supported on the lower part 52 and presses the sealing membrane 70 against the fixing sleeve 64.

The lower part 52 has an end face 83 in which a conical flange 84 is formed coaxially to the outer circumferential surface of the lower part 52, which flange surrounds the outlet opening 24 of the adapter 14. The lower part 52 has the thread 56 on its outer circumferential surface and is designed in such a way that it can be introduced into the upper part 54 and can be screwed to the latter, with the result that the upper part 54 partially circumferentially surrounds the lower part 52. The lower part 52 has, at an axial end opposite to the end face 83, a free end 86 which bears on the fixing sleeve 64 in a region of the rib 66 so as to press the latter into the groove 62.

The filling nozzle 28 of the pump 16 is arranged in the outlet opening 24 of the adapter 14 in such a way that the flange 84 coaxially surrounds the filling nozzle 28. The basic body 26 of the pump 16 has the cylindrical outlet nozzle 38 which lies opposite to the filling nozzle 28 and is arranged at an angle with respect to an axis of the filling nozzle 28. Fastened to an axial end of the outlet nozzle 38 opposite to the basic body 26 is the spout valve 40 which has a dispenser opening 88. The pump flange 32 is formed in the basic body 26 between the filling nozzle 28 and the outlet nozzle 38. The pump flange is oriented transversely to the longitudinal axis. Acting on the pump membrane 34, which seals the pump flange 32, is the pump plunger 36 which is formed on a side facing the pump membrane 34 in such a way that it can be introduced at least partially through the pump flange 32 into the basic body 26 in order to reduce or to increase a pump chamber in the basic body 26.

The inside diameter of the circumferential edge 68 of the fixing sleeve 64 is smaller than or equal to the outside diameter of the neck 18 of the container 12 such that the neck 18 can be accommodated by the inlet opening 22 of the adapter 14 and fixedly surrounded by the fixing sleeve 64. The fixing sleeve 64 is fastened to the upper part 50 in that the annular rib 66 of the fixing sleeve 64 engages in the peripheral groove 62 of the upper part 50 and is pressed into the groove 62 by the free end 86 of the lower part 52. By means of the threads 56 and 58, the upper part 50 is firmly screwed to the lower part 52 and the rib 66 of the fixing sleeve 64 is pressed into the groove 62 of the upper part 50, with the result that the fixing sleeve 64 is simultaneously fixed by the free end 86. By introducing the neck 18 into the inlet opening 22 of the adapter 14, the neck 18 presses against the sealing membrane 70 and displaces the line portion 74, which is connected in one piece to the sealing membrane 70, in the axial direction toward the pump 16, with the result that the conical portion 78 is introduced between an inner circumferential surface of the flange 84 and an outer circumferential surface of the filling nozzle 28.

The filling nozzle 28 can be formed as a suction or filling opening of any type. This means that as an alternative a nozzle can also be formed on the adapter 14 which is connected to an opening in the basic body 26 of the pump 16.

Figure 3:
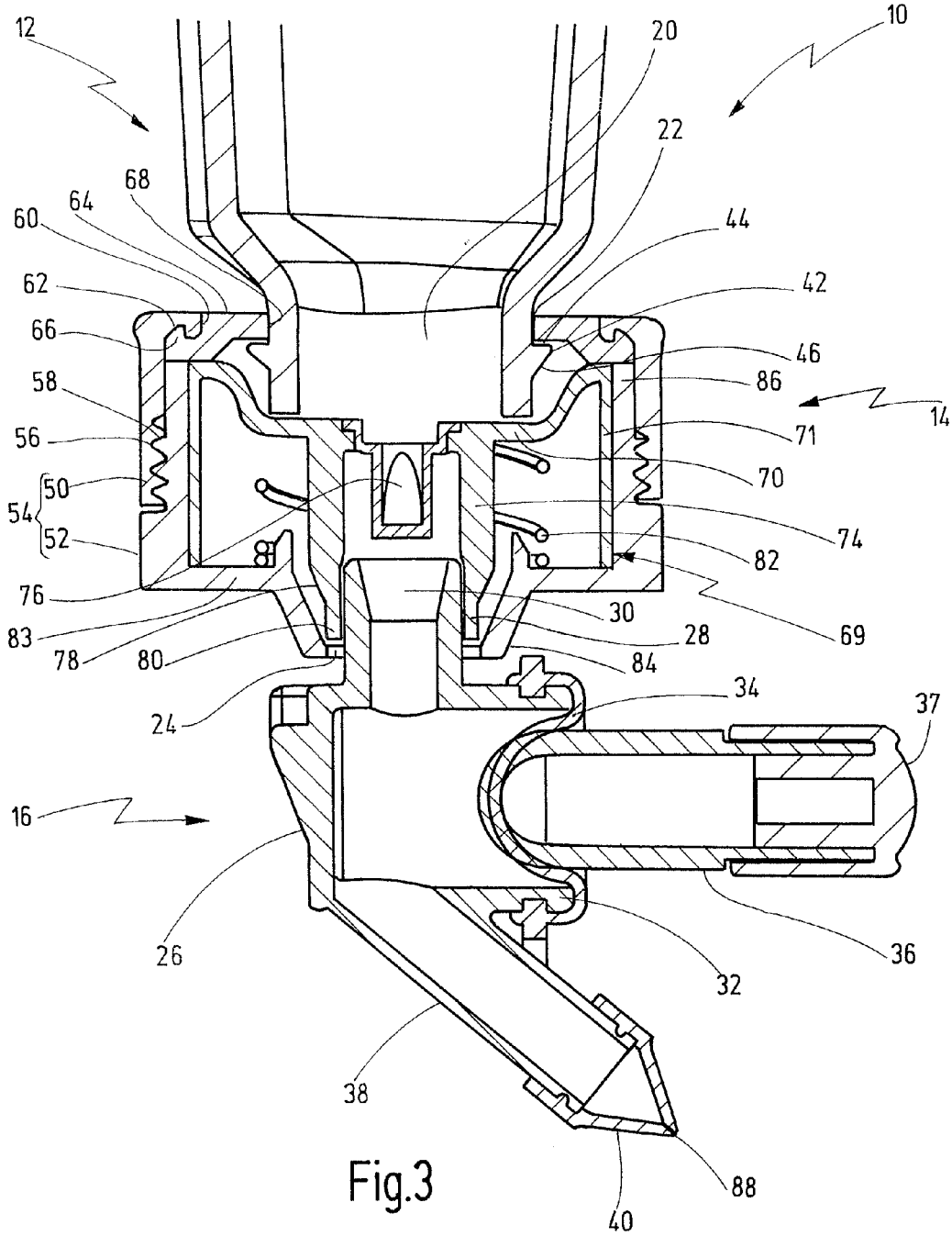
FIG. 3 shows a sectional view of an embodiment of the dosing apparatus in which the adapter is connected ready for operation to the container and to the pump.

FIG. 3 shows a sectional view of the dosing apparatus 10 ready for operation.

In FIG. 3, the neck 18 of the container 12 is arranged in the inlet opening 22 of the adapter 14 in such a way that the perpendicular portion 44 of the collar 42 engages behind the inner circumferential edge 68 of the fixing sleeve 64. With respect to a position which is represented in FIG. 2, the line portion 74 is displaced axially in the direction of the flange 84. The conical portion 78 of the line portion 74 is arranged between the inner circumferential surface of the flange 84 and the outer circumferential surface of the filling nozzle 28.

Because the inside diameter of the circumferential edge 68 is identical or smaller than the outside diameter of the neck 18 and because the perpendicular portion 44 engages the circumferential edge 68 of the fixing sleeve 64, the container 12 is mechanically fixedly connected to the adapter 14. The oblique portion 46 of the collar 42 facilitates the introduction of the neck 18 into the inlet opening 22. The perpendicular portion 44 of the collar 42 engages behind the fixing sleeve 64 and prevents the container 12 being pressed out of this position. The neck 18 presses against the sealing membrane 70, and a spring force which is exerted by the coil spring 82 in the direction of the container 12 presses the sealing membrane 70 against the neck 18. As a result, the neck 18 forms a sealed connection with the sealing membrane 70.

In the position represented in FIG. 3, the line portion 74 in the region of the conical portion 78 tightly surrounds the filling nozzle 28. Here, the inside diameter of the line portion 74 is identical to the outside diameter of the filling nozzle 28 so as to form a sealed connection. The projection 80, which reduces the inside diameter of the line portion 74 at this end, furthermore serves to improve the sealing of the line portion 74 with respect to the filling nozzle 28. In this position, the conical portion 78 is arranged between the inner circumferential surface of the flange 84 and the outer circumferential surface of the filling nozzle 28.

In the operating position represented in FIG. 3, a sealed connection is thus formed between the container 12 via the adapter 14 and the pump 16 up to the dispenser opening 88 in the spout valve 40. Here, the spout valve 40 exclusively allows the substance to be conveyed out of the pump 16. Since the nonreturn valve 76 in the line portion 74 permits a flow direction of the pasty substance exclusively in the direction of the pump 16, actuating the pump 16 causes the pasty substance from the container 12 to be conveyed through the adapter 14 and the basic body 26 out of the dispenser opening 88. Here, the pump acts as follows.

By exerting a force on the cap 37, the pump plunger 36 is pressed into the basic body 26 of the pump 16 and, as a result of the sealed connection between the pump membrane 34 and the pump flange 32, produces an overpressure in the basic body 26. The nonreturn valve 76 prevents this overpressure from escaping into the container 12. The spout valve 40 allows this overpressure to escape through the dispenser opening 88 in that, if the basic body 26 is filled with pasty substance, some of the pasty substance is dispensed through the dispenser opening 88. If the pump plunger 36 retreats by an elastic restoring force which is produced by a deflection of the elastic pump membrane 34, a negative pressure results in the basic body 26. The spout valve 40 prevents this negative pressure being equalized by sucking in, for example, ambient air. The nonreturn valve 76 allows the negative pressure to be able to be equalized by sucking in pasty substance from the container 12. As a result, by moving the pump plunger 36 into the basic body 26 and by retreating the pump plunger 36 from the basic body 26, pasty substance can be sucked out of the container 12 and be dispensed dosed through the dispenser opening 88.

By exchanging the fixing sleeve 64 with sleeves which have a different shape or a different inside diameter of the circumferential edge 68, different containers with different diameters of the neck 18 can be used, for example the container 12 shown which is suitable for accommodating pasty substances (for example soap)from supply packs, but also any type of freely commercially available tubes (toothpaste tubes for example).

Because the housing 54 is formed from the upper part 50 and the lower part 52 and these parts can be easily separated or connected by means of the threads 56 and 58, the adapter 14 can easily be cleaned to remove residues of the pasty substance.

The pump 16 can be easily cleaned just like the adapter 14. This is possible because the basic body 26 has three openings and at least the pump membrane 34 on the pump flange 32 and preferably also the spout valve 40 on the outlet nozzle 38 are releasably connected, with the result that cleaning is possible without residues remaining in the basic body 26.

This allows the use of a single dosing apparatus 10 for different pasty substances in succession, which, for example for hygienic reasons, should not come into contact with one another.

As a variant of the embodiment of the adapter represented in FIGS. 2 and 3, it is also conceivable for the line portion 74 to be introduced into the filling nozzle 28 of the pump 16 in order to form a sealed connection. Here, the filling nozzle 28 is clamped in between the line portion 74 and the flange 84 and can thus form a mechanically stable connection. It will be understood that this variant of the adapter can be applied to all embodiments of the adapter.

Figure 4:
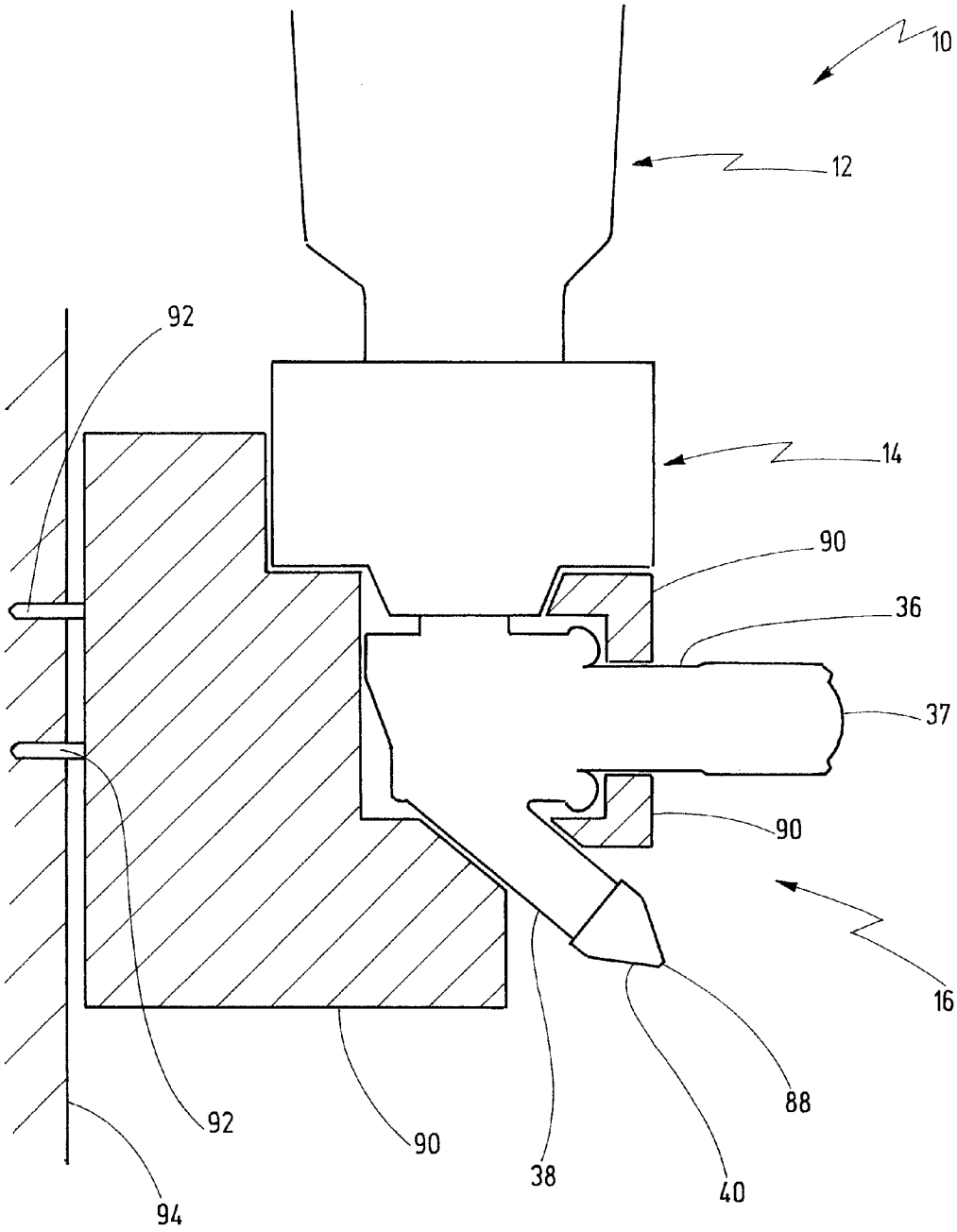
FIG. 4 shows a schematic sectional view of a holding device for the dosing apparatus according to the invention.

FIG. 4 shows a schematic sectional view of a holder in which the dosing apparatus 10 according to the invention is accommodated.

FIG. 4 shows the dosing apparatus 10 in a schematic representation with the container 12, the adapter 14 and the pump 16. The dosing apparatus 10 is accommodated in a holding device 90 which is fixed by means of anchoring elements 92 in a wall 94.

The holding device 90 is designed in such a way that the outlet nozzle 38 protrudes from the holding device with the spout valve 40 and the dispenser opening 88, and the pump plunger 36 protrudes from the holding device with the cap 37 and thus are accessible for a user. Furthermore, the adapter 14 and the container 12 protrude from the holding device 90 in order to ensure a simple exchange of the container 12. The holding device 90 is anchored in the wall 94 by means of the anchoring elements 92 in order to fixedly mount the dosing apparatus 10. The holding device 90 is designed in such a way that it fixedly encloses the pump 16. Furthermore, the holding device 90 can be opened so that the dosing apparatus 10 can be easily released from the holding device 90 for cleaning.

It is also conceivable for the holding device 90 to be designed as a base which can stand on a horizontal surface and thus securely mounts the dosing apparatus.

Figure 5:
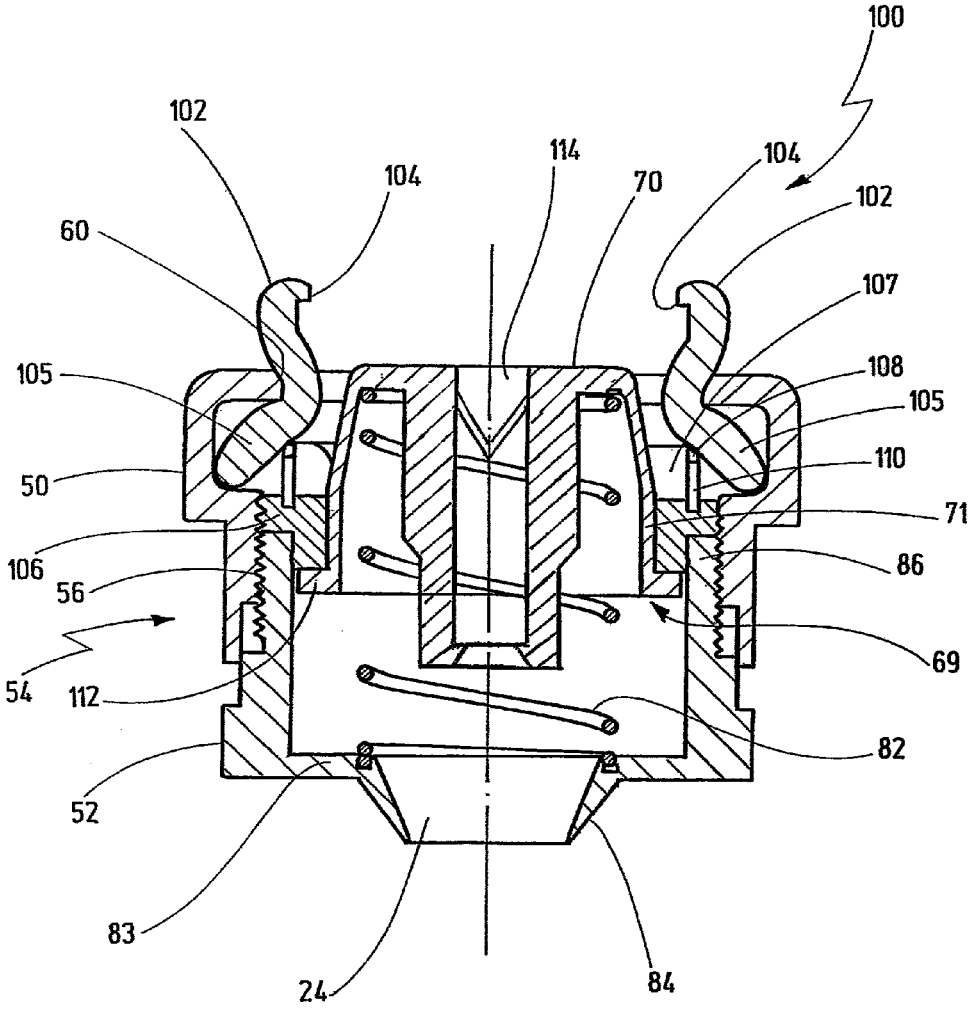
FIG. 5 shows a sectional view of an alternative embodiment of the adapter with fixing grippers.

FIG. 5 shows a schematic sectional view of an alternative embodiment of the adapter with fixing grippers. The adapter represented in FIG. 5 is generally designated by 100. Identical elements are designated by identical reference numbers, although here only the differences over the adapter shown in FIG. 2 are described.

The adapter has two fixing grippers 102 which are arranged in the opening 60 of the upper part 50 and partially protrude from the adapter 100. The fixing grippers 102 each have an engagement portion 104 which serves to be connected to the perpendicular portion 44 of the collar 42. The fixing grippers 102 have an actuating portion 105 inside the adapter 100. The fixing grippers 102 are mounted inside the housing 54 by means of a holding ring 106. The holding ring 106 is formed in a lower region as a continuous ring which is represented in dashed lines in FIG. 5. The holding ring 106 is designed to be interrupted in an upper portion by cutouts 107. The cutouts 107 are formed in the region of the fixing grippers 102 and accommodate the actuating portion 105 of the fixing grippers 102. The holding ring 106 is mounted at the free end 86 of the lower part 52. Provided in the holding ring 106 is a circumferential groove 110 which is of elongate design in the axial direction of the adapter 100 and in which a restoring ring 108 is arranged. The sealing member 69 comprises the cylindrical element 71 and the sealing membrane 70. Furthermore, an edge 112 which bears on the holding ring 106 is formed at a lower end of the cylindrical element 71. The coil spring 82 is arranged between the sealing membrane 70 and the end face 83 of the lower part 52.

The fixing grippers 102 are movably mounted in the cutouts 107 of the restoring ring 108. During an outward pivoting movement of the engagement portions 104 in the radial direction, the actuating portions 105 of the fixing grippers 102 are pivoted radially inwardly, with the result that the holding ring 106 is deflected in the groove 110 in the axial direction. If the lower part 52 is screwed by means of the thread 56 to the upper part 50, the lower portion of the holding ring 106 is pressed in the axial direction against the actuating portions 105, with the result that the actuating portions 105 are blocked from being pivoted out and the engagement portions 104 are pressed radially inwardly. Consequently, the engagement portions 104 are brought into engagement with, for example, the collar 42 of the container 12 and fix the container 12 to the adapter 100. The fixing grippers 102 are resiliently mounted by means of the restoring ring 108, with the result that the fixing grippers 102 can pivot out when plugging the adapter 100 onto the neck 18 and the engagement portions 104 engage behind the collar 42. By screwing the lower part 52 to the upper part 50, the fixing grippers 102 can be fixed in this position.

By means of the coil spring 82, the sealing membrane 70 is pressed in the axial direction against the neck 18 of the container 12 and thereby seals the opening 20. Pasty material can pass from the container 12 into the adapter 100 through an opening 114 formed in the sealing membrane 70.

Preferably, the adapter 100 has four fixing grippers 102 distributed in the circumferential direction in order to securely fix the container 12. However, it is also conceivable for the adapter 100 to have only three or more fixing grippers.

The line portion 74 with the nonreturn valve 76 and with the conical portion 78 for fixing the filling nozzle 28 of the pump 16 is not represented separately in FIG. 5. It will be understood that the line portion 74 with the nonreturn valve 76 is provided between the opening 114 and the outlet opening 24 of the embodiment according to FIG. 5, as is represented in FIG. 2.

Figure 6:
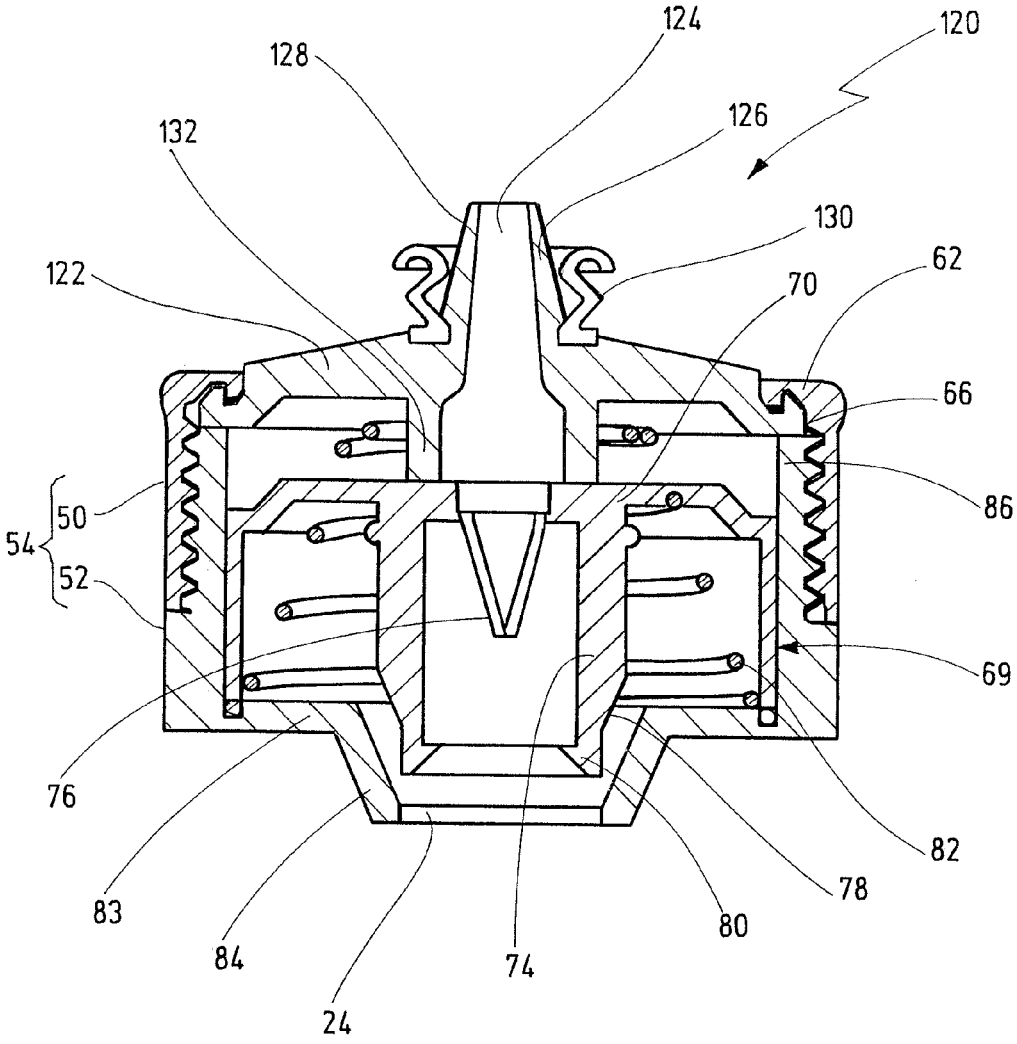
FIG. 6 shows a sectional view of an embodiment of the adapter with a fixing screw.

In FIG. 6, a sectional representation of an embodiment of the adapter with a screw connection is schematically represented. The adapter with screw connection is generally designated by 120. Identical elements are designated with identical reference numbers, although here only the differences are explained.

The adapter 120 has a screw element 122 which has the circumferential rib 66. The rib 66 is accommodated in the circumferential groove 62 of the upper part 50.

The screw element 122 has an opening 124 which is formed by an axially projecting attachment portion 126. The attachment portion 126 has a screw portion 128 which is formed on an outer circumferential surface of the attachment portion 126. The attachment portion 126 is surrounded by a seal 130. The screw element 122 has a cylindrical portion 132 on a side opposite to the attachment portion 126. The cylindrical portion 132 is connected to the opening 124. In the representation of the adapter 120 in FIG. 6, the upper part 50 is screwed to the lower part 52. As described in the explanations with regard to FIG. 2, the free end 86 here fixes the rib 66 in the groove 62. The cylindrical portion 132 bears on the sealing membrane 70 of the sealing member 69. The coil spring 82 is arranged between the sealing membrane 70 and the end face 83.

By means of the coil spring 82, the sealing membrane 70 of the sealing member 69 is pressed against the cylindrical portion 132 of the screw element 122 and thus forms a sealed connection between the opening 124 and the line portion 74. The attachment portion 126 is provided circumferentially with the screw portion 128 in order to screw the attachment portion 126 to an attachment portion of the container 12. Here, an edge of the opening 20 of the container 12 is pressed axially against the seal 130 and forms a seal connection between the opening 20 and the opening 124 of the adapter 120.

The screw portion 128 of the attachment portion 126 can, for example, be screwed into an internal thread of the neck 18 of the container 12 and thus connect the opening 124 to the opening 20.

It is also conceivable that the container 12 does not have a neck 18 and the screw portion 128 is screwed directly into the opening 20 of the container 12. For that purpose, a thread can be provided on an inner side of the opening 20. It is also conceivable that the screw portion 128 has a cutting thread. As a result, the screw portion 128 can cut a thread into the connecting portion of the container 12 when screwing in and thus produce a stable connection with the container.

It is also conceivable that the screw portion 128 is formed on the inner side of the attachment portion and is screwed onto the neck 18 of the container 12. Here, the inner screw portion 128 can likewise have a cutting thread. As a result, the adapter 120 can be screwed onto the neck 18 of virtually any design, since the cutting thread cuts a thread into the connecting portion of the neck 18 when screwing on.

What is claimed is:

1. An adapter for a dosing dispenser having an inlet opening and an outlet opening for connecting a pump to a container, comprising a fixing element which is arranged on the inlet opening for holding a neck or a connecting portion of the container;

a line portion which connects the pump to the container, wherein a valve which determines a flow direction in the line portion is arranged in the line portion;

a sealing member which has a sealing membrane which forms a sealed connection between the line portion and the neck or the connecting portion;

a housing to which the sealing membrane and the fixing element are fastened, wherein the fixing element is designed to be exchangeable separately from the sealing membrane, wherein the sealing membrane is movable in the axial direction and elastically preloaded by means of a spring element.

2. The adapter as claimed in claim 1, wherein the housing is formed of an upper part and a lower part.

3. The adapter as claimed in claim 2, wherein the fixing element has, on an outer edge, a rib portion which engages in a groove portion on an inner edge of the opening of the upper part.

4. The adapter as claimed in claim 2, wherein a cylindrical portion is arranged between a conical flange of the lower part and a filling nozzle of the pump when it surrounds the filling nozzle.

5. The adapter as claimed in claim 1, wherein the sealing membrane and the line portion are formed in one piece.

6. The adapter as claimed in claim 1, wherein the fixing element has at least one fixing gripper which can be brought into engagement with a connecting portion of the container.

7. The adapter as claimed in claim 1, wherein the fixing element has a screw portion which can be connected to a connecting portion of the container.

8. The adapter as claimed in claim 1, wherein the valve is designed as a nonreturn valve.

9. The adapter as claimed in claim 1, wherein the line portion has, at an end opposite to the sealing membrane, a cylindrical portion which is designed to surround a filling nozzle of the pump if the sealing membrane is pressed in by introducing a neck of a container into the adapter.

10. The adapter as claimed in claim 1, wherein the line portion has, at an end opposite to the sealing membrane, a cylindrical portion which is designed to be introduced into a filling nozzle of the pump if the sealing membrane is pressed in by introducing a neck of a container into the adapter.

11. The adapter as claimed in claim 1, wherein the spring element is designed as a coil spring.

12. The adapter as claimed in claim 1, wherein the sealing member has a double-cylindrical component of an elastic material, wherein two coaxial cylinders are connected to the sealing membrane.

13. The adapter as claimed in claim 12, wherein the valve is arranged in an inner cylinder of the sealing member.

14. A dosing apparatus for fluid substances, including a pump to pump the substance out of a container; and an adapter having an inlet opening and an outlet opening for connecting the pump to the container, the adapter comprising a fixing element which is arranged on the inlet opening for holding a neck or a connecting portion of the container;

a line portion which connects the pump to the container, wherein a valve which determines a flow direction in the line portion is arranged in the line portion;

a sealing member which has a sealing membrane which forms a sealed connection between the line portion and the neck or the connecting portion;

a housing to which the sealing membrane and the fixing element is fastened, wherein the fixing element is designed to be exchangeable separately from the sealing membrane, wherein the sealing membrane is movable in the axial direction and elastically preloaded by means of a spring element.

15. The dosing apparatus as claimed in claim 14, wherein a connection between a suction opening of the pump and the outlet opening of the adapter is designed to be releasable and a filling nozzle is formed coaxially to the adapter.

* * * * *